US009567744B2

(12) United States Patent
Lu et al.

(10) Patent No.: US 9,567,744 B2
(45) Date of Patent: Feb. 14, 2017

(54) IMPACT RESISTING COLUMN ASSEMBLY OF A TRAIN STATION

(71) Applicant: Tsinghua University, Beijing (CN)

(72) Inventors: Xinzheng Lu, Beijing (CN); Qing Jiang, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 0 days.

(21) Appl. No.: 15/030,912

(22) PCT Filed: Jan. 3, 2014

(86) PCT No.: PCT/CN2014/070078

§ 371 (c)(1),
(2) Date: Apr. 21, 2016

(87) PCT Pub. No.: WO2015/058469

PCT Pub. Date: Apr. 30, 2015

(65) Prior Publication Data

US 2016/0244965 A1 Aug. 25, 2016

(30) Foreign Application Priority Data

Oct. 21, 2013 (CN) ..... 2013 1 0495815
Oct. 21, 2013 (CN) ..... 2013 2 0649961 U

(51) Int. Cl.
*E04C 3/34* (2006.01)
*E04B 1/92* (2006.01)
(Continued)

(52) U.S. Cl.
CPC . *E04B 1/92* (2013.01); *B61B 1/02* (2013.01); *E04C 3/29* (2013.01); *E04C 3/293* (2013.01);
(Continued)

(58) Field of Classification Search
CPC ..... E04C 3/34; E04C 3/30; E01F 15/141; E02B 3/26; E04H 12/2292; E04F 13/0736
(Continued)

(56) References Cited

U.S. PATENT DOCUMENTS 1,804,320 A * 5/1931 Cross ..... E04F 13/0733 52/249
4,583,716 A * 4/1986 Stephens ..... E01F 15/146 188/377

(Continued)

*Primary Examiner* — Rodney Mintz
*Assistant Examiner* — Daniel Kenny
(74) *Attorney, Agent, or Firm* — Kile Park Reed & Houtteman PLLC

(57) ABSTRACT

An impact resisting column assembly of train station is provided. The column assembly includes: a column (2); an encasing steel plate (8) wrapping about the column (2); a rigid jacket (3) having a rectangular cross-section, fitted over the encasing steel plate (8) and spaced apart from the encasing steel plate (8); and mild steel energy dissipators (7) disposed between a first side (81) of the encasing steel plate (8) and a first side (31) of the rigid jacket (3), and between a second side (82) of the encasing steel plate (8) and a second side (31) of the rigid jacket (3), in which the first and second sides (81, 82) are parallel with each other and perpendicular to an extension direction of a railway (1) in the train station, and the first and second sides (31, 32) are parallel with each other and perpendicular to the extension direction.

17 Claims, 2 Drawing Sheets

(51) Int. Cl.

| | |
|---|---|
| ***E04C 3/29*** | (2006.01) |
| ***E04C 3/293*** | (2006.01) |
| ***E04C 3/36*** | (2006.01) |
| ***B61B 1/02*** | (2006.01) |
| ***E04C 3/30*** | (2006.01) |
| ***E04H 9/00*** | (2006.01) |

(52) U.S. Cl.
CPC . *E04C 3/30* (2013.01); *E04C 3/34* (2013.01); *E04C 3/36* (2013.01); *E04H 9/00* (2013.01)

(58) Field of Classification Search
USPC ..... 256/13.1; 52/834; 404/6; 405/216
See application file for complete search history.

(56) References Cited

U.S. PATENT DOCUMENTS

| | | | | |
|---|---|---|---|---|
| 5,605,414 | A * | 2/1997 | Fuller | E01F 15/0469 116/63 R |
| D380,274 | S * | 6/1997 | Stamets | D25/38.1 |
| 6,242,070 | B1 * | 6/2001 | Gillispie | E01F 15/141 428/122 |
| 6,309,140 | B1 * | 10/2001 | Kiedaisch | E01F 15/0415 114/219 |
| 8,484,787 | B2 * | 7/2013 | Voyiadjis | F16F 7/12 14/75 |
| 9,267,286 | B2 * | 2/2016 | Kim | E04C 3/34 |

* cited by examiner

IMPACT RESISTING COLUMN ASSEMBLY OF A TRAIN STATION

CROSS REFERENCE TO RELATED APPLICATIONS

This application is a U.S. national phase application of International Application No. PCT/CN2014/070078, filed on Jan. 3, 2014, which is based upon and claims priority of Chinese Patent Applications No. 201310495815.7 and No. 201320649961.6 filed with State Intellectual Property Office, P. R. C. on Oct. 21, 2013, the entire content of which is incorporated herein by reference.

FIELD

Embodiments of the present disclosure generally relate to a rail traffic field, more particularly, to an impact resisting column assembly of train station.

BACKGROUND

The derailment accident as a significant issue for railway security cannot be ignored. The train derailment accident in various countries is a common occurrence due to increased speed, unreasonable railway preventive measures, bad weather and the trains' own problems, and may cause heavy loss of lives and property.

Especially for the high-speed train, once the train is derailed and impacts on the buildings around the station due to its high speed, a serious secondary disaster will be caused. Therefore, researches on highly effective and reliable protective structures for resisting the impact of derailed trains are significant.

The train station adjacent to the railway is the most likely to be subjected to the impact of the derailed trains and may be destroyed seriously. The structure of the modern train station is long-span and elevated, and the high-speed trains pass through the root of the long-span and elevated structure at a high speed (namely the main track) or stop at the root of the long-span and elevated structure (namely the arrival and departure track).

Due to limitations of various factors, a distance from the outer edge of the column of the train station to the maximum-safe contour line of the train is restricted, almost less than 1 m, which causes the research on the highly effective and reliable column for resisting the lateral impact of the derailed train to confront serious challenges. Meanwhile, considering high cost of the high-speed train and the safety of passengers in the train, the column cannot be built as strong as possible, otherwise the train may be damaged and serious casualties may be caused when the derailed train impacts the column.

SUMMARY

Embodiments of the present disclosure provide an impact resisting column assembly of train station which may effectively attenuate the energy of lateral impacts of the derailed trains via the mild steel energy dissipators, and greatly improve the safety of the train station and the passengers in the derailed trains.

Accordingly, an impact resisting column assembly of train station according to embodiment of the present invention is provided, includes: a column; an encasing steel plate wrapping about the column; a rigid jacket having a rectangular cross-section, fitted over the encasing steel plate and spaced apart from the encasing steel plate; and mild steel energy dissipators disposed between a first side of the encasing steel plate and a first side of the rigid jacket, and between a second side of the encasing steel plate and a second side of the rigid jacket, in which the first and second sides of the encasing steel plate are parallel with each other and perpendicular to an extension direction of a railway in the train station, and the first and second sides of the rigid jacket are parallel with each other and perpendicular to the extension direction of the railway.

With the encasing steel plate and the rigid jacket wrapping about the column and the mild steel energy dissipators disposed between the encasing steel plate and the rigid jacket, the impact resisting column assembly may effectively attenuate the energy of lateral impacts of the derailed trains, weaken the strength of the impact hit on the column and reduce the damage to the derailed trains and the passengers therein, thus greatly improving the safety of the train station and the passengers in the derailed trains.

In some embodiments, the rigid jacket includes: an inner steel plate connected to the mild steel dissipators; an outer steel plate disposed at an outside of the inner steel plate and spaced apart from the inner steel plate; reinforcing ribs disposed between the inner steel plate and the outer steel plate. The rigid jacket may dissipate the impact energy of the derailed trains hit on the column and transmit the impact energy to the mild steel energy dissipators.

In some embodiments, the inner steel plate, the outer steel plate and the reinforcing ribs are welded into one piece, which may be assembled on site, thus reducing the construction difficulty of the rigid jacket.

In some embodiments, a lower end of the encasing steel plate is extended downwardly to be adjacent to a bottom of the column. Therefore, the encasing steel plate wraps about the column from the bottom up, thus improving the strength and rigidity of the column.

In some embodiments, an upper end surface of the encasing steel plate is flush with that of the rigid jacket.

In some embodiments, a length of the rigid jacket ranges from 1.5 m to 2.5 m.

In some embodiments, a height from a center of the rigid jacket in a vertical direction to a horizontal plane in which the railway is located ranges from 1 m to 2 m In some embodiments, a distance from a side of the rigid jacket parallel with the extension direction to a side of the encasing steel plate adjacent to the side of the rigid jacket ranges from 200 mm to 800 mm. Therefore, the column assembly may be disposed in a small space and mounted on various types of new or existing train station, such that the impact resisting column assembly has a great practicability and adaptability.

In some embodiments, the mild steel energy dissipators are connected with each other in a horizontal direction.

In some embodiments, the mild steel energy dissipators are arranged into a plurality of rows spaced apart from one another in a vertical direction.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
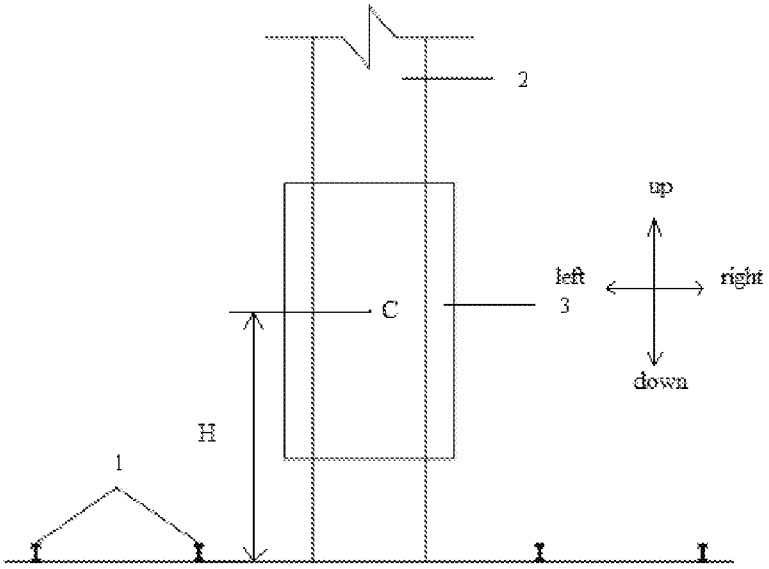
FIG. 1 is a schematic view of an installation of impact resisting columns in train station according to an embodiment of the present invention.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, unless specified or limited otherwise, relative terms such as "central", "longitudinal", "lateral", "front", "rear", "right", "left", "inner", "encasing", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of the technical features. Thus, the technical feature limited by "first" and "second" may indicate or imply to include one or more technical features. In the description of the present disclosure, term "a plurality of" means two or more than two, unless otherwise specified.

In the description of the present disclosure, unless specified or limited otherwise, it should be noted that, terms "mounted," "connected" "coupled" and "fastened" may be understood broadly, such as permanent connection or detachable connection, electronic connection or mechanical connection, direct connection or indirect connection via intermediary, inner communication or interaction between two elements. These having ordinary skills in the art should understand the specific meanings in the present disclosure according to specific situations.

In the description of the present disclosure, a structure in which a first feature being "on" a second feature may include an embodiment in which the first feature directly contacts the second feature, and may also include an embodiment in which the first feature and the second feature are indirectly contact by an additional feature therebetween, unless otherwise specified.

Furthermore, a first feature being "above" or "on top of" a second feature may include an embodiment in which the first feature is right "above" or "on top of" the second feature, and may also include an embodiment in which the first feature is not right "above" or "on top of" the second feature, or merely means that a height of the first feature is higher than that of the second feature. While the first feature "beneath," "below," or "on bottom of" the second feature may include an embodiment in which the first feature is right "beneath," "below," or "on bottom of" the second feature, and may also include an embodiment in which the first feature is not right "beneath," "below," or "on bottom of" the second feature, or merely means that the height of the first feature is lower than that of the second feature.

The impact resisting column assembly of the train station according to embodiments of the present invention will be described in detail with reference to FIGS. 1-4.

In some embodiments, the column assembly of the train station includes: a column 2, an encasing steel plate 8, a rigid jacket 3 and mild steel energy dissipators 7.

The column 2 may be a reinforced concrete structure, a concrete-filled steel tube structure or a steel reinforced concrete structure.

The encasing steel plate 8 may have a rectangular cross-section by welding four steel plates together, such that the encasing steel plate 8 is fitted over the column 2.

Figure 2:
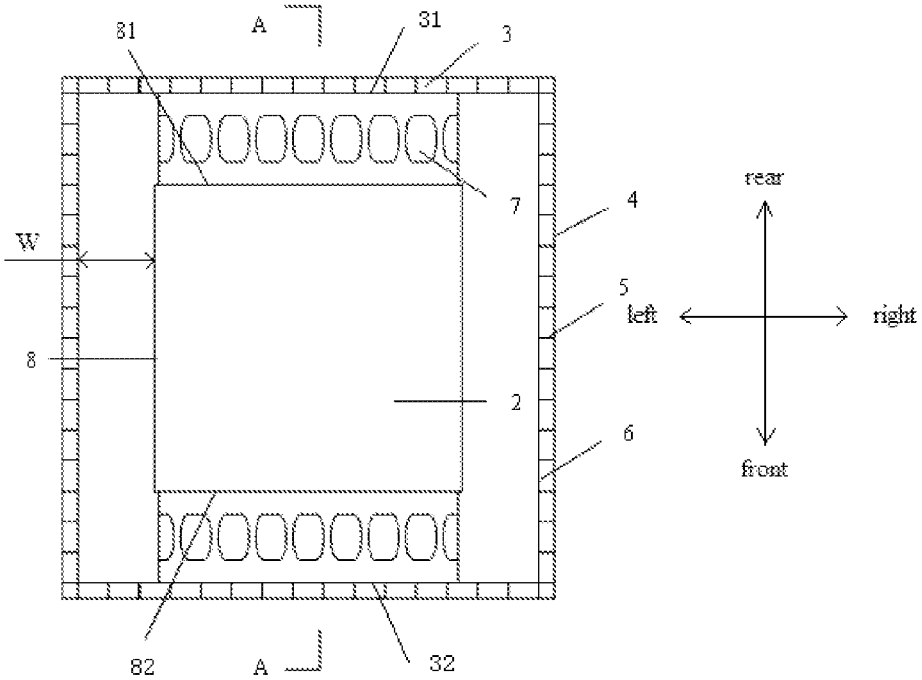
FIG. 2 is a cross-sectional view of an installation of impact resisting columns in train station according to an embodiment of the present invention along a front-rear direction.

As shown in FIG. 2, the cross-section of the column 2 is rectangular, the encasing steel plate 8 tightly warps about a peripheral wall of the column 2.

Figure 4:
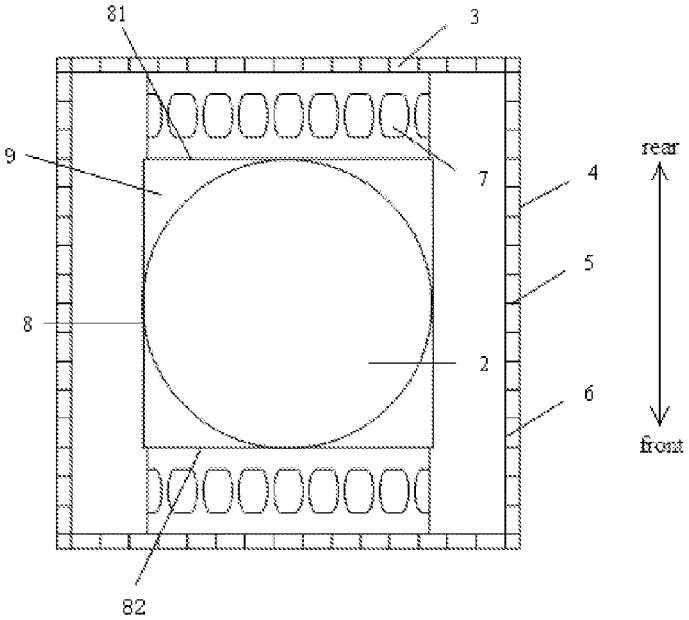
FIG. 4 is a cross-sectional view of an installation of impact resisting columns in train station according to another embodiment of the present invention.

When the cross-section of the column 2 is not rectangular, for example, as shown in FIG. 4, the cross-section of the column 2 is circular, the encasing steel plate 8 cannot tightly wrap about the peripheral wall of the column 2, such that a space 9 is formed between the encasing steel plate 8 and the column 2 into which concrete may be poured so as to reinforce the column 2. Therefore, the encasing steel plate 8 may further reinforce the column 2 and greatly improve the bearing capacity of the column 2.

The encasing steel plate 8 may wrap about the column 2 from the bottom up, in other words, a lower end of the encasing steel plate 8 may be extended downwards to a bottom of the column 2. The encasing steel plate 8 may extend upwards to a top of the column 2.

As shown in FIG. 2, the rigid jacket 3 is fitted over the encasing steel plate 8 and a cross-section of the rigid jacket 3 may be rectangular. The rigid jacket 3 is spaced apart from the encasing steel plate 8. The mild steel energy dissipators 7 are disposed in a space between the rigid jacket 3 and the encasing steel plate 8, and the rigid jacket 3 may dissipate the impact energy of the derailed trains hit on the column 2 and transmit the impact energy to the mild steel energy dissipators 7.

The encasing steel plate 8 may be used as a connecting element of the mild steel energy dissipator 7, i.e., the mild steel energy dissipators 7 may be fixed on the encasing steel plate 8.

The mild steel energy dissipators 7 may greatly attenuate the lateral (a left-right direction in FIG. 1) impact energy of the derailed trains until the impact energy is completely absorbed. The mild steel dissipators 7 has a low strength and a high energy dissipation, which may not only improve the safety of the column resisting the lateral impact, but also maximally reduce the damage to the derailed trains and the passengers therein and ensure the safety of the train station and the persons therein.

As shown in FIG. 2, the encasing steel plate 8 has a first side 81 (i.e., a rear end surface in FIG. 2) and a second side 82 (i.e., a front end surface in FIG. 2), and the first side 81 and the second side 82 are parallel with each other and perpendicular to an extension direction of the railway 1. The rigid jacket 3 has a first side 31 (i.e., a rear end surface in FIG. 2) and a second side 32 (i.e., a front end surface in FIG. 2), and the first side 31 and the second side 32 are parallel with each other and perpendicular to the extension direction of the railway 1.

The mild steel energy dissipators 7 are disposed between the first side 81 of the encasing steel plate 8 and the first side 31 of the rigid jacket 3, and between the second side 82 of the encasing steel plate 8 and the second side 32 of the rigid jacket 3.

When the train is derailed and hits on the column 2 transversely, firstly, the train hits on the rigid jacket 3 which can dissipate the impact energy hit thereon and transmit the impact energy to the mild steel energy dissipators 7 along the lateral direction. Next, the mild steel energy dissipators 7 greatly attenuates the lateral impact energy of the derailed train, and the encasing steel plate 8 wraps about the column 2 to provide further protection for the column 2. Therefore, the column assembly may effectively attenuate the lateral impact energy of the derailed train so as to reduce the damage to the derailed train and the passengers therein, and weaken the strength of the impact hit on the column 2 so as to greatly improve the safety of the train station and the persons therein.

By disposing the encasing steel plate 8 and the rigid jacket 3 around the column 2 and providing the mild steel energy dissipators 7 between the encasing steel plate 8 and the rigid jacket 3, the column assembly according to embodiments of the present invention may effectively attenuate the lateral impact energy of the derailed trains so as to reduce the damage to the derailed trains and the passengers therein, and weaken the strength of the impact hit on the column so as to improve the safety of the train station and the persons therein.

In some embodiments, the rigid jacket 3 includes an inner steel plate 6, an outer steel plate 4 and reinforcing ribs 5. The inner steel plate 6 may be connected to the mild steel energy dissipators 7 fixedly, such that the rigid jacket 3 may transmit the impact energy of the derailed trains hit on the column 2 to the mild steel energy dissipators 7.

The outer steel plate 4 is disposed at an outside of the inner steel plate 6 and spaced apart from the inner steel plate 6.

Moreover, the reinforcing ribs 5 are disposed between the inner steel plate 6 and the outer steel plate 4. The reinforcing ribs 5 may improve the strength and the rigidity of the rigid jacket 3, and dissipate the impact energy of the derailed trains hit on the column 2, thus improving the reliability of the rigid jacket 3. Therefore, the rigid jacket 3 may effectively transmit the impact energy of the derailed trains hit on the column 2 to the mild steel energy dissipators 7.

Alternatively, the inner steel plate 6, the outer steel plate 4 and the reinforcing ribs 5 are welded into one piece to form the rigid jacket 3, in which the reinforcing ribs 5 are welded with the inner steel plate 6 and the outer steel plate 4 respectively. Thus, the rigid jacket 3 can be assembled on site, such that the construction difficulty of the steel jacket 3 is reduced.

In some embodiments, the encasing steel plate 8 may extend from the bottom of the column 2 up to the upper surface of the rigid jacket 3. In other words, the upper surface of the encasing steel plate 8 is flush with the upper surface of the rigid jacket 3, thus greatly improving the strength and rigidity of the column 2.

A length of the rigid jacket 3 may range from 1.5 m to 2.5 m, and a height H from a center C of the rigid jacket 3 in a vertical direction (i.e. an up-down direction in FIG. 1) to a horizontal plane in which a railway 1 is located ranges from 1 m to 2 m.

A distance W from a side of the rigid jacket 3 parallel with the extension direction of the railway 1 to a side of the encasing steel plate 8 adjacent to the side of the rigid jacket 3 (i.e., the distance W between the left inner steel plate 6 of the rigid jacket 3 and the left side of the encasing steel plate 8 or between the right inner steel plate 6 of the rigid jacket 3 and the right side of the encasing steel plate 8, as shown in FIG. 2) ranges from 200 mm to 800 mm. Therefore, the column assembly may be disposed in a small space and mounted on various types of new or existing train station, thus having a great practicability and adaptability.

However, the present invention is not limited to this, and the length of the rigid jacket 3, the height H and the distance W may be adjusted according to practice conditions.

In some embodiments, the mild steel energy dissipators 7 are connected with each other in a horizontal direction.

Figure 3:
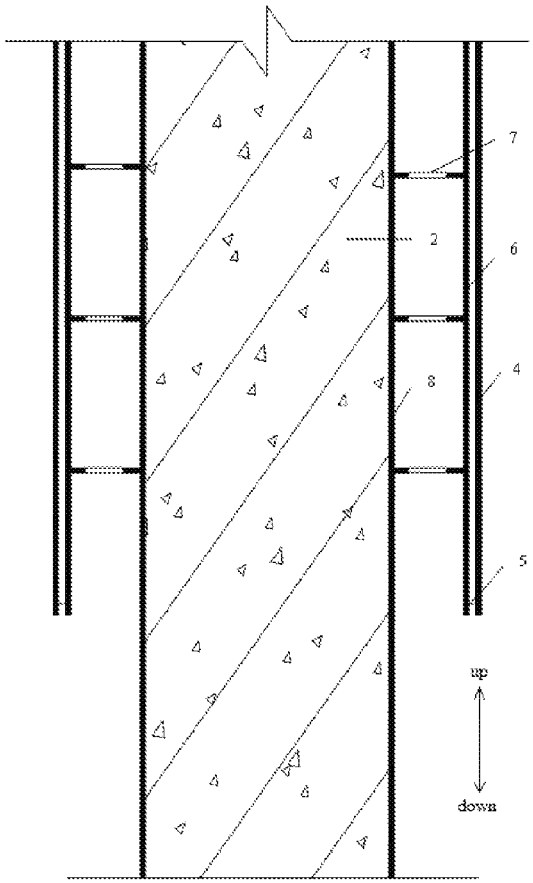
FIG. 3 is a cross-sectional view of the impact resisting column assembly along line A-A in FIG. 2.

As shown in FIG. 3, alternatively, the mild steel energy dissipators 7 are arranged into a plurality of rows spaced apart from one another in a vertical direction so as to further attenuate the lateral impact energy of the derailed trains.

The number $n_t$ of mild steel energy dissipators 7 in each row and the number k of rows may be derived according to the following calculations.

First, according to a determined distance d between the maximum-safe contour line of the train parallel with the extension direction of the railway 1 and the column 2, the maximum displacement of the mild steel energy dissipator 7 may be preliminarily given by:

$$d_m = d - d_s - (100 \sim 600)\ \text{mm} \tag{1}$$

where $d_m$ is the maximum displacement of the mild steel energy dissipator 7, and $d_s$ is the minimum safe distance from the maximum-safe contour line of the train to the maximum-safe contour line of the building.

A model of the mild steel energy dissipator 7 may be preliminarily determined according to $d_m$, and for convenient calculation, an ideal elastic-plastic model is adopted as the restoring force model of the mild steel energy dissipator 7, such that the dissipated energy when the mild steel energy dissipator 7 generates a displacement $d_o$ is given by:

$$W_d = P_y(d_o - d_y) \tag{2}$$

where $W_d$ is the dissipated energy when the mild steel energy dissipator 7 generates a displacement $d_o$, $P_y$ is the yield force of the mild steel energy dissipator 7, and $d_y$ is the yield displacement of the mild steel energy dissipator 7.

Then, the maximum dissipated energy of the mild steel energy dissipator 7 is given by:

$$W_{d\ max} = P_y(d_m - d_y) \tag{3}$$

where $W_{d\ max}$ is the maximum dissipated energy of the mild steel energy dissipator 7.

According to a fortification criteria of the train station and the distance d between the maximum-safe contour line of the train and the column, the lateral impact fortified speed $v_{max}$ of the column may be derived, and then the lateral impact energy E of the derailed train is given by:

$$E = \frac{1}{2} m v_{max}^2 \tag{4}$$

where E is the lateral impact energy of the derailed train, m is the effective calculated mass of the lateral impact, and $v_{max}$ is the lateral impact fortified speed.

In order to protect the column 2 from being damaged after being hit by the derailed train, the following formula needs to be satisfied:

$$\begin{cases} nW_{d\,max} \geq E \\ nP_y \leq F \end{cases} \quad (5)$$

where F is the surplus lateral load resistance of the column 2 without the mild steel energy dissipators 7 parallel to the railway 1, and n is the number of the mild steel energy dissipators 7.

According to the number and size of the mild steel energy dissipators 7 and a length of the column 2 perpendicular to the extension direction of the railway 1, the number $n_i$ of the mild steel energy dissipators 7 in each row at the side of the column 2 and the number k of the necessary rows may be determined, in which k is not less than 2 and $$n = 2\sum_{1}^{k} n_i,$$

and whether n satisfies the formula (5) is determined.

When the rigid jacket 3 is designed, it is should be required that the rigid jacket 3 is in an elastic state under the action of F.

Therefore, the number $n_i$ of the mild steel energy dissipators 7 in each row and the number m of the necessary rows may be determined according to practice conditions.

The present invention will be described with reference to an embodiment.

The cross-section of the column 2 of a high-speed railway train station is shown in FIG. 4, the column 2 is a concrete-filled steel tube structure, in which a model of the steel tube is Q345, the column 2 has an outer diameter of 1300 mm and a wall thickness of 35 mm, and a strength grade of the concrete is C40. Furthermore, by calculating and analyzing the total structure of the column, F is 43234 kN. The distance d between the maximum-safe contour line of the train parallel to the extension direction of the railway 1 and the column 2 is 1000 mm, $d_s$=300 mm.

$$\text{Then, } d_m = d - d_s - (100\sim400)\text{ mm} = 1000 - 300 - (100\sim600) = 100\sim600 \quad (6)$$

In this embodiment, $d_m$ is initially set to 200 mm, i.e., $d_m$=200 mm, and the mild steel energy dissipator 7 may be an X-model damper according to $d_m$, which has a height of 600 mm, a width of 300 mm, a yield strength of 117 MPa, a yield force $P_y$=2.17×10$^5$N, a yield displacement $d_y$=8 mm, and a maximum displacement of 20 mm.

When the mild energy dissipator 7 generates the maximum displacement (200 mm), a dissipated energy $W_{d\,max}$ is:

$$W_{d\,max} = P_y(d_m - d_y) = 2.17\times10^5\times(200-8) = 4.166\times10^4\text{ J} \quad (7)$$

According to the fortification criteria of the train station and the distance d between the maximum-safe contour line of the train and the column, the lateral impact fortified speed $v_{max}$ of the column may be given as 14 m/s, i.e., $v_{max}$=14 m/s. In this embodiment, the model of the train is CRH2E and a weight of a single section of the train is 56 t, such that the effective calculated mass m is 56 t. Then, the lateral impact energy E of the derailed train is:

$$E = \frac{1}{2}mv_{max}^2 = \frac{1}{2}\times56\times10^3\times14^2 = 5.488\times10^6\text{ J} \quad (8)$$

Formulas (7) and (8), and values of $P_y$ and F are substituted into the formula (5) to obtain:

$$\begin{cases} n\times4.166\times10^4 \geq 5.488\times10^6 \\ n\times2.17\times10^5 \leq 4.323\times10^7 \end{cases}, \text{ i.e., } \begin{cases} n \geq 131.7 \\ n \leq 199.2 \end{cases}$$

When n cannot meet the formula (5), it means that the maximum displacement of the mild steel energy dissipator 7 is too small, and the value of $d_m$ should be increased. If the space is such limited that the value of $d_m$ cannot be increased, then n should be a small value and be an even number.

When n meets the formula (5), n should be as small as possible. In this embodiment, n=132.

According to the number and size of the mild steel energy dissipators 7 and the length of the column 2 perpendicular to the extension direction of the railway 1, the number $n_i$ of the mild steel energy dissipators 7 in each row at the side of the column 2 may be determined.

In this embodiment, the number of the mild steel energy dissipators 7 in each of rows 1 to 8 may be 4, the number of the mild steel energy dissipators 7 in row 9 may be 2 and the number of the mild steel energy dissipators 7 in each of rows 10 to 17 may be 4.

In other words, at the first side 81 of the encasing steel plate 8, the number of the mild steel energy dissipators 7 in each of rows 1 to 8 is 4, the number of the mild steel energy dissipators 7 in row 9 is 2, and the number of the mild steel energy dissipators 7 in each of rows 10 to 17 is 4; at the second side 82 of the encasing steel plate 8, the number of the mild steel energy dissipators 7 in each of rows 1 to 8 is 4, the number of the mild steel energy dissipators 7 in row 9 is 2, and the number of the mild steel energy dissipators 7 in each of rows 10 to 17 is 4.

Moreover, the mild steel energy dissipators 7 at the first side 81 are symmetrical with the mild steel energy dissipators 7 at the second side 82.

m is not less than 2 and $$n = 2\sum_{1}^{m} n_i = 132.$$

When an initial velocity of the train is 14 m/s, after the train hits on the column, a final recoil velocity of the train is 0.4735 m/s, and the dissipated energy accounts for 99.89% of the total energy.

When the initial velocity of the train is 9 m/s, after the train hits on the column, the final recoil velocity is 1.1322 m/s, and the dissipated energy accounts for 98.42% of the total energy.

When the initial velocity of the train is 6 m/s, after the train hits on the column, the final recoil velocity is 0.6592 m/s, and the dissipated energy accounts for 98.79% of the total energy.

Accordingly, the column assembly according to embodiments of the present invention may not only improve the safety of the column subjected to the lateral impact of the train, but also attenuate the motion energy of the train. Thus, the column assembly can maximally reduce the damage to the derailed trains and the passengers therein, and ensure the safety of the train station and the persons therein. Moreover, the column assembly may be disposed in a small space and mounted on various types of new or existing train station, thus having a great practicability and adaptability.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An impact resisting column assembly of a train station, comprising:

a column;

an encasing steel plate wrapping about the column;

a rigid jacket having a rectangular cross-section, fitted over the encasing steel plate and spaced apart from the encasing steel plate; and mild steel energy dissipators disposed between a first side of the encasing steel plate and a first side of the rigid jacket, and between a second side of the encasing steel plate and a second side of the rigid jacket, wherein the first and second sides of the encasing steel plate are parallel with each other and perpendicular to an extension direction of a railway in the train station, and the first and second sides of the rigid jacket are parallel with each other and perpendicular to the extension direction of the railway.

2. The column assembly of claim 1, wherein the rigid jacket comprises:

an inner steel plate connected to the mild steel dissipators;

an outer steel plate disposed at an outside of the inner steel plate and spaced apart from the inner steel plate;

reinforcing ribs disposed between the inner steel plate and the outer steel plate.

3. The column assembly of claim 2, wherein the inner steel plate, the outer steel plate and the reinforcing ribs are welded into one piece.

4. The column assembly of claim 1, wherein a lower end of the encasing steel plate is extended downwardly to be adjacent to a bottom of the column.

5. The column assembly of claim 1, wherein an upper end surface of the encasing steel plate is flush with that of the rigid jacket.

6. The column assembly of claim 1, wherein a length of the rigid jacket ranges from 1.5 m to 2.5 m.

7. The column assembly of claim 6, wherein a height from a center of the rigid jacket in a vertical direction to a horizontal plane in which the railway is located ranges from 1 m to 2 m.

8. The column assembly of claim 7, wherein a distance from a side of the rigid jacket parallel with the extension direction to a side of the encasing steel plate adjacent to the side of the rigid jacket ranges from 200 mm to 800 mm.

9. The column assembly of claim 1, wherein the mild steel energy dissipators are connected with each other in a horizontal direction.

10. The column assembly of claim 9, wherein the mild steel energy dissipators are arranged into a plurality of rows spaced apart from one another in a vertical direction.

11. The column assembly of claim 2, wherein a lower end of the encasing steel plate is extended downwardly to be adjacent to a bottom of the column.

12. The column assembly of claim 2, wherein an upper end surface of the encasing steel plate is flush with that of the rigid jacket.

13. The column assembly of claim 2, wherein a length of the rigid jacket ranges from 1.5 m to 2.5 m.

14. The column assembly of claim 13, wherein a height from a center of the rigid jacket in a vertical direction to a horizontal plane in which the railway is located ranges from 1 m to 2 m.

15. The column assembly of claim 14, wherein a distance from a side of the rigid jacket parallel with the extension direction to a side of the encasing steel plate adjacent to the side of the rigid jacket ranges from 200 mm to 800 mm.

16. The column assembly of claim 2, wherein the mild steel energy dissipators are connected with each other in a horizontal direction.

17. The column assembly of claim 16, wherein the mild steel energy dissipators are arranged into a plurality of rows spaced apart from one another in a vertical direction.

* * * * *